United States Patent [19]

Bako et al.

[11] 4,366,684

[45] Jan. 4, 1983

[54] LATCHING DEVICE FOR APERTURED MEMBERS

[75] Inventors: Lazlo Bako, Woodcliff Lake; Richard C. Remington, Pompton Plains, both of N.J.

[73] Assignee: Presto Lock, Inc., Garfield, N.J.

[21] Appl. No.: 180,926

[22] Filed: Aug. 25, 1980

[51] Int. Cl.[3] ..... E05B 37/02

[52] U.S. Cl. ..... 70/68; 70/312; 70/318

[58] Field of Search ..... 70/67-76, 70/312, 315-318; 292/334

[56] References Cited

U.S. PATENT DOCUMENTS

| | | | |
|---|---|---|---|
| 2,812,204 | 11/1957 | Squire | 292/334 |
| 3,319,743 | 5/1967 | Pelavin et al. | 190/41 |
| 3,597,945 | 8/1971 | Feinberg | 70/74 |
| 3,965,706 | 6/1976 | Davis | 70/68 |
| 3,971,458 | 7/1976 | Koenig | 190/41 |
| 3,973,419 | 8/1976 | Atkinson | 70/68 |
| 4,031,723 | 6/1977 | Samhammer et al. | 70/68 |

*Primary Examiner*—Robert L. Wolfe
*Attorney, Agent, or Firm*—Shapiro and Shapiro

[57] ABSTRACT

A latching device for apertured members, such as the sliders of a double-slider zipper employed as a closure on a luggage case, has a latch pivotally mounted on a body member and an upstanding stud which is adapted to be covered by the latch when in latched position. The latching device employs a latching mechanism which is operated by the movement of the pivoted latch without the necessity of manipulating a secondary, manual actuator, thereby permitting the latching device to be operated with one hand. The device includes a pair of plungers slideably disposed within a housing, the plungers having end portions extending beyond the housing which are shaped for cooperation with cams attached to the underside of the latch. The plungers are driven into the housing by the cams when the latch is lowered or raised. When the latch is open, the plungers are held partially driven into the housing, thereby reducing the downward force necessary to close the latch. A combination lock is included within the device to lock the latch in latched position.

18 Claims, 12 Drawing Figures

FIG. 5.
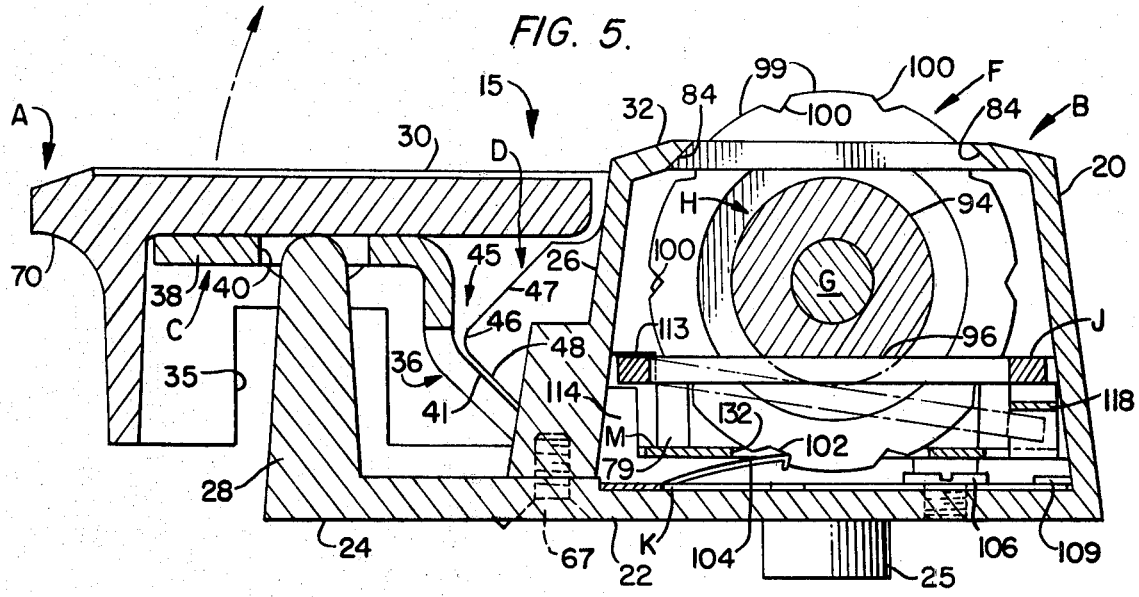
FIG. 6.
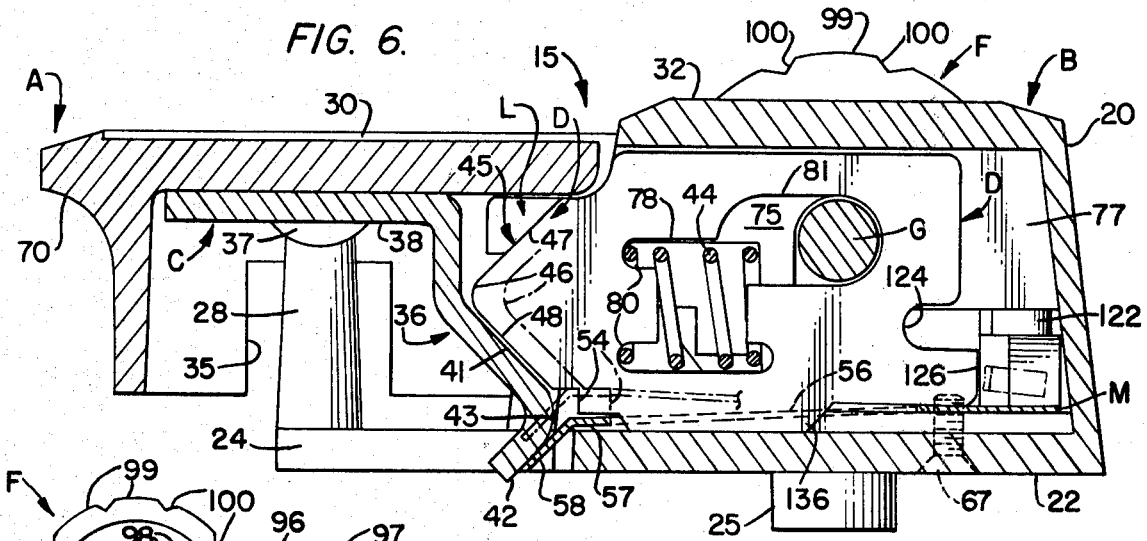
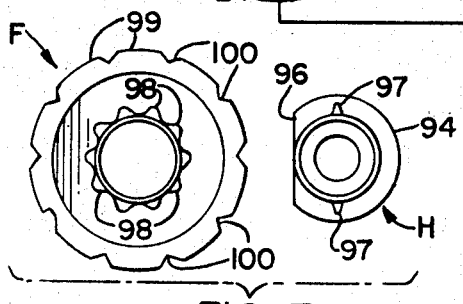
FIG. 7.
FIG. 8.
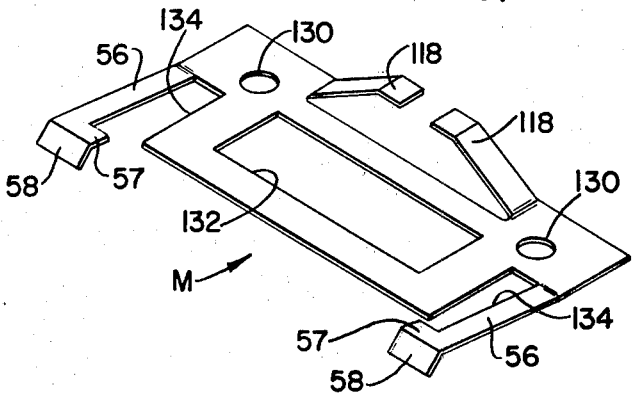
FIG. 9.
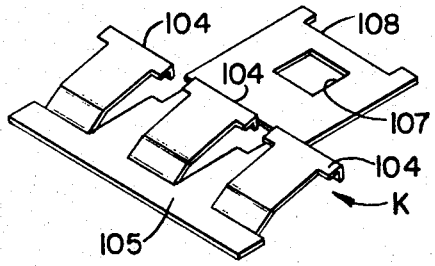

LATCHING DEVICE FOR APERTURED MEMBERS

BACKGROUND OF THE INVENTION

This invention relates generally to latching devices, and more particularly to latching devices which employ multiple-dial combination locks and which are well adapted for use on luggage cases and the like.

A latching device of the type which employs a latch pivotally connected to a base plate, upon which is positioned an upstanding stud adapted to be covered by the latch, is particularly well adapted as a latching device for articles such as luggage which utilize a closure having an apertured member. For example, U.S. Pat. No. 3,597,945 to Feinberg, issued Aug. 10, 1971, and assigned to the same assignee as the present invention, discloses such a latching device for latching together the apertured sliders of a slide fastener used as a closure for a luggage case. As disclosed therein, a hook attached to the underside of the latch is received in a slot in an extended portion of a base plate and engaged by a slideably disposed plug within the base plate to hold the latch in latched position. The plug is spring biased toward engagement with the hook and is attached to a manually operated actuator. To open the latch, the actuator must be held depressed against the bias of the spring to disengage the plug from the hook while the latch is simultaneously lifted. A multiple-dial combination locking mechanism within the device prevents movement of the plug to unlatched position when the lock is "off combination".

U.S. Pat. No. 3,319,743 to Pelavin et al, issued May 16, 1967, discloses another pivoted latch latching device which employs a key-released locking mechanism to hold a pivoting latch in latched position. A key is required to unlock the locking mechanism to permit the device to be unlatched.

While latching devices such as these work satisfactorily, they are difficult or impossible to open with one hand, which is inconvenient. Moreover, mechanisms which require the manipulation of a key or an actuator to unlatch the device tend to complicate the latching device and increase its size. In addition, when used as a latching device for a double-slider zipper, the latches may not completely cover the sliders, subjecting the sliders to damage, and may leave an undesirable gap in the zipper when it is closed.

SUMMARY OF THE INVENTION

Accordingly, a principal object of the invention is to provide a new and improved latching device of the type having a latch pivotally mounted on a body member.

A further object of the invention is to provide an improved latching device having a small size and a compact, simple operating mechanism which is capable of one-handed operation.

A still further object of the invention is to provide an improved latching device which does not require an actuator separate from the latch for opening the device.

Another object of the invention is to provide an improved latching device having means for reducing the force required to close the latch.

An additional object of the invention is to provide an improved latching device which incorporates combination locking means for locking the device in a latched position.

Yet a further object of the invention is to provide a latching device for a double-slider zipper which covers the sliders and does not leave an undesirable gap in the zipper when the zipper is closed.

Briefly stated, in one aspect, a latching device in accordance with the invention for latching the slider of a zipper may include a base, a housing mounted on the base, the base having a portion extending beyond the housing, a stud mounted on the extended portion of the base formed to be received through an aperture in a zipper slider pull tab, a latch pivotally mounted on the base, the latch having a latched position at which it covers the stud and the zipper slider and an unlatched position, plunger means slideably related to the housing for releasably engaging cooperable means on the latch for holding the latch in latched position, the plunger means being driven into the housing by the cooperable means when the latch is moved between latched and unlatched positions, and reslient means for biasing the plunger means toward engagement with the cooperable means on the latch.

In another aspect, a latching device in accordance with the invention includes a housing, a latch pivotally mounted on the housing, the latch having a latched position at which the latch is adjacent to the housing and having an unlatched position at which the latch is pivoted away from the housing, plunger means slideably related to the housing and being releasably engageable with the latch to hold the latch in latched position, the plunger means being driven into the housing by the latch when the latch moves between latched and unlatched positions, resilient means for biasing the plunger means toward engagement with the latch, and means for holding the plunger means at least partially driven into the housing when the latch is in unlatched position, thereby reducing the force required to move the latch to latched position.

BRIEF DESCRIPTION OF THE DRAWINGS

FIGS. 5 and 6 are transverse sectional views taken approximately along lines 5—5 and 6—6, respectively, of FIG. 3;

FIG. 7 is an elevational view illustrating a dial and an associated flanged sleeve comprising elements of a combination lock of the invention;

FIG. 8 is a perspective view of a bolt spring of the combination lock;

FIG. 9 is a perspective view of a dial spring of the combination lock;

DESCRIPTION OF THE PREFERRED EMBODIMENT

A latching device in accordance with the invention is particularly well adapted for use with luggage or similar articles which employ a double-slider zipper or slide fastener as the closure for the case, and the invention will be described in that environment for illustrative purposes. It will become apparent, however, that the invention may be employed in a variety of applications.

Conventionally, two types of double-slider zipper arrangements may be employed as luggage case closures, and the invention is applicable to both. The first type employs a single continuous slide fastener with fastener elements or scoops of the double-acting type. The second type employs two slide fasteners having single-acting fastener elements, the zippers being arranged with their top stop ends adjacent to one another so that the sliders can be brought together when the zippers are closed.

Figure 2:
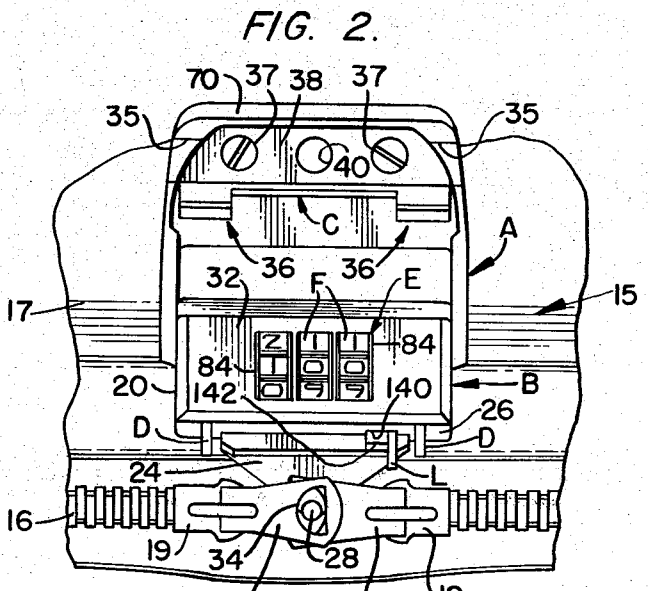
FIG. 2 is a view similar to FIG. 1, this view showing the latch in unlatched position.
Figure 1:
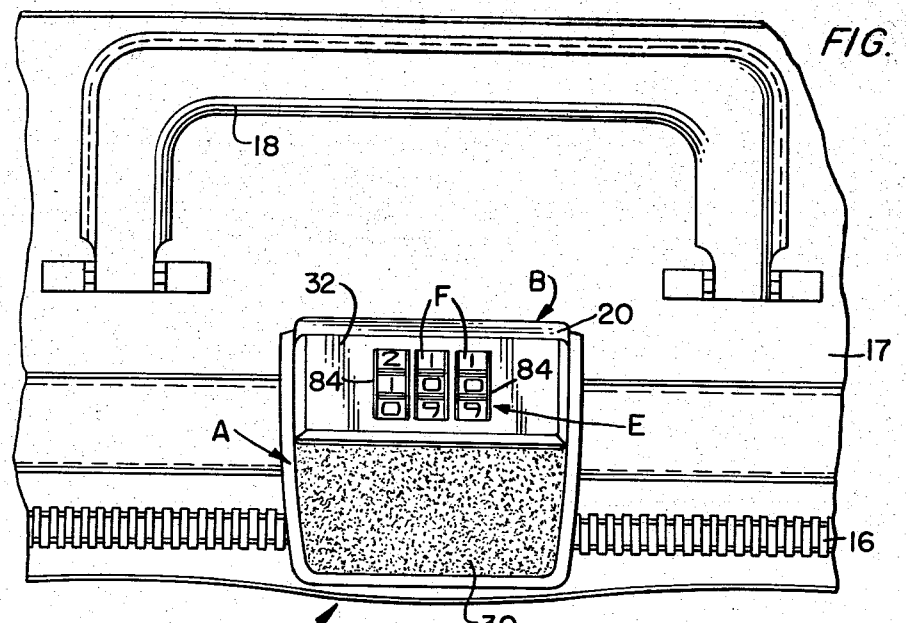
FIG. 1 is a top plan view of a latching device in accordance with the invention, the latching device being attached to a luggage case, partially shown, and the latch being shown in latched position.

A latching device 15 in accordance with the invention is shown in FIGS. 1 and 2 of the drawings employed with a zipper arrangement of the first type, having a single zipper 16 employed as a closure on a soft-sided luggage case 17, for example. Latching device 15 may be mounted on the case adjacent to a carrying handle 18 of the case and related to zipper 16 so that opposed zipper sliders 19 may be latched together when the zipper is closed.

As illustrated in the figures, a latching device in accordance with the invention generally comprises a latch A pivotally mounted on a body member B which may include a housing 20 attached to a base plate or frame 22. The frame has a portion 24 which extends beyond a front face 26 of the housing, and the frame may include mounting posts 25 on its underside for attaching the latching device to the side wall of luggage case 17 in a well-known manner. An upstanding stud 28 is located on the extended portion of the frame. As best illustrated in FIGS. 5 and 6, in latched position latch A covers stud 28, and the top surface 30 of latch A is substantially flush with the top or face plate 32 of housing 20.

Figure 3:
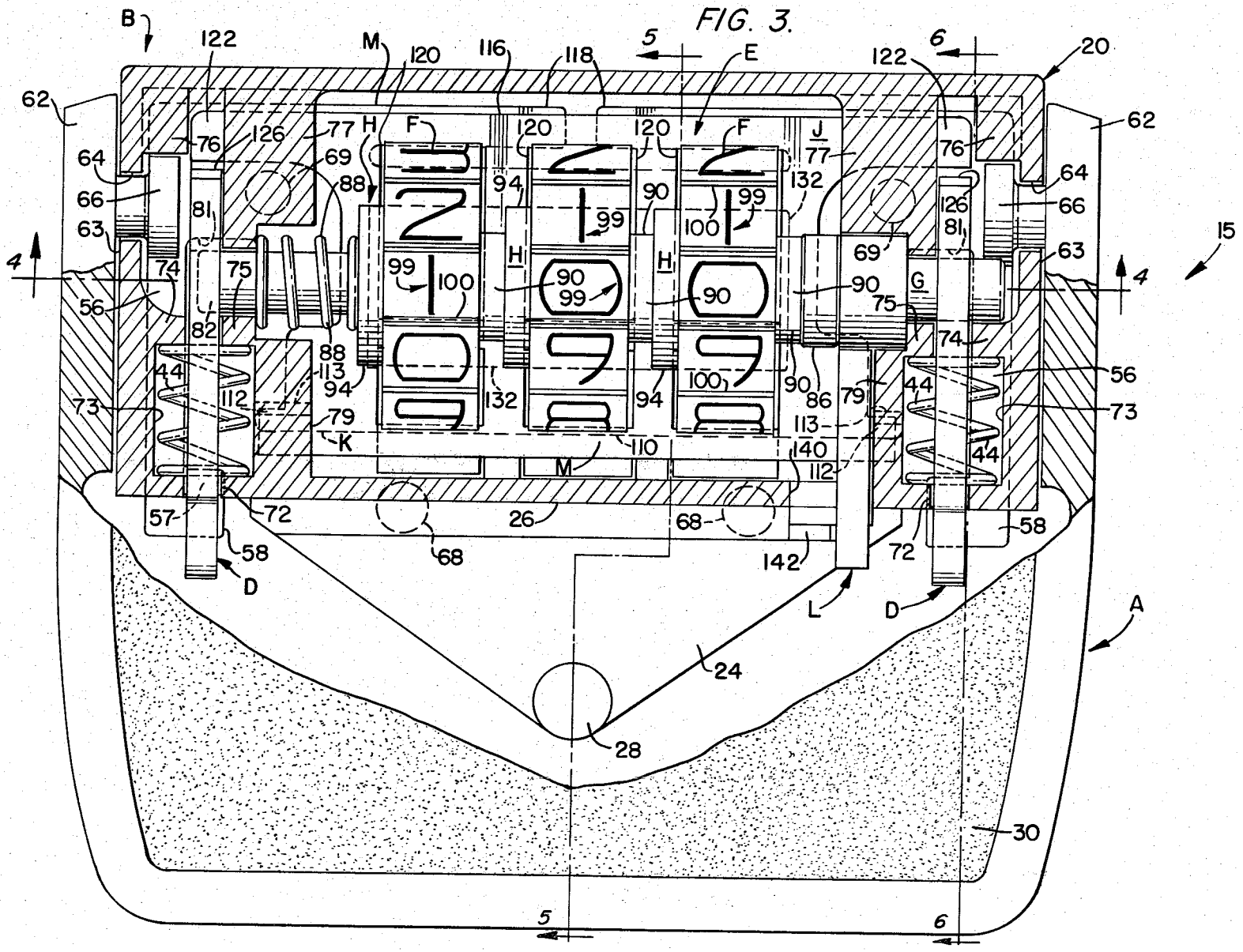
FIG. 3 is an enlarged top plan view partially broken away of the latching device of FIG. 1, this view omitting the luggage case.

As illustrated in FIGS. 2 and 3, the extended portion 24 of the frame is preferably angular or pointed with stud 28 positioned at the apex or tip of the extended portion. Latching device 15 may be related to zipper 16 so that when sliders 19 are brought together to close the zipper, their pull tabs 33 may be placed over stud 28, as illustrated in FIG. 2, by threading the stud through an aperture or hole 34 conventionally formed in the pull tabs. When latched, latch A covers the stud and the sliders, preventing the pull tabs from slipping off of the stud, thereby securely fastening the sliders together. The angular shape of the extended portion 24 of the frame allows the sliders to be positioned relatively closely to one another, minimizing the gap in the zipper when it is closed. Preferably, latch A is wide enough to cover the sliders when it is in latched position, thereby protecting the sliders from damage. A cutout 35 may be formed in opposite sides of latch A, as best illustrated in FIGS. 5 and 6, and positioned with respect to the stud to receive the sliders when the latch is in latched position. Combination locking means, designated generally as E, may be incorporated within the latching device to lock latch A in latched position, as will be described.

The latching device of the invention incorporates a novel latching mechanism which does not require manipulation of a separate actuator or key for its operation, and which permits operation of the device with one hand. The construction and the operation of the latching mechanism will first be described generally in order to highlight several significant aspects, and then a more detailed description of the latching device will follow.

The latching mechanism is operated simply by manually operating latch A. To open the latching device, latch A is lifted to provide access to the stud. To close the device, latch A is lowered to cover the stud, the latching mechanism having a "snap" action to snap latch A closed, as will be described hereinafter.

As shown in FIGS. 2, 5, and 6, a cam member C (shown in detail in FIG. 11) is attached to the underside of latch A. Cam member C preferably has a pair of spaced cams 36 projecting from a plate 38. Cams 36 are shaped to cooperate with a pair of plungers D slideably disposed on frame 22, the plungers being spaced for engagement with the cams. Preferably, the cams and the plungers are arranged so that the plungers are located adjacent to opposite ends of front face 26 of housing 20, as shown in FIGS. 2 and 3. The plungers are spring biased outwardly from housing 20 by coil springs 44, as will be described in detail later. Plungers D, and their corresponding cams 36, are preferably identical so that each plunger cooperates with its corresponding cam in the same manner. As latch A is raised and lowered to open and close it, cams 36 drive the plungers into the housing against the bias of springs 44, allowing the latch to be moved past the plungers. When the latch is closed, engagement between cams 36 and the plungers holds the latch in latched position (FIGS 5 and 6). As will be described hereinafter, when combination lock E is "off combination" movement of the plungers into the housing is blocked, thereby locking the device in latched position. As will also be described, latching device 15 preferably incorporates means for holding the plungers partially driven into the housing when latch A is in unlatched position, in order to reduce the force necessary to move the latch to latched position.

Figure 11:
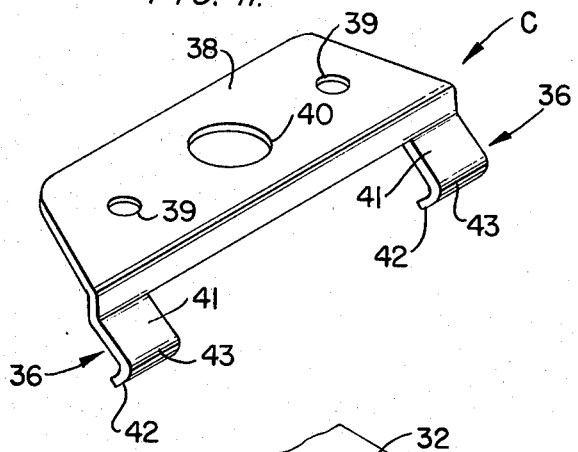
FIG. 11 is a perspective view of a cam member in accordance with the invention.

In greater detail now, cam member C is preferably stamped from hard steel in the shape illustrated in FIG. 11. The cam member may be attached to the underside of latch A in any convenient manner, as by threaded fasteners 37 which extend through holes 39 in plate 38 and are threaded into aligned openings (not illustrated) on the underside of the latch. A centrally positioned hole 40 may be located in plate 38 to receive stud 28 when latch A is in latched position, allowing the stud to abut the underside of the latch as shown in FIG. 5. Cams 36 project downwardly from the side of plate 38 adjacent to plungers D. As best illustrated in FIGS. 5 and 6, each cam has a first downwardly sloping cam surface 41 and a second shorter cam surface 42 extending from cam surface 41 at approximately a right angle, imparting a backward (in the figures) L-shape to each cam. Cam surfaces 41 and 42 are connected by a rounded cam surface 43, as illustrated.

Plungers D are also preferably stamped from hard steel as planar members having a shape best illustrated in FIG. 6. Each plunger has a wedge-shaped end portion 45 which extends through a slot 49 (FIG. 12) in the front face 26 of the housing. Each wedge-shaped end portion 45 has a rounded tip 46 and a pair of sloping surfaces 47, 48 disposed symmetrically with respect to the longitudinal axis of the plunger, surface 47 sloping upwardly from tip 46 and surface 48 sloping downwardly at approximately a right angle to surface 47. As shown in FIGS. 5 and 6, surface 48 is correspondingly sloped to engage cam surface 41 when the latch is in latched position.

Cams 36 and end portions 45 of the plungers cooperate in the following manner to provide a latching mechanism. As previously indicated, plungers D are slideably disposed on frame 22 and biased outwardly from the housing by coil springs 44 (in a manner which will be described shortly). When latch A is closed, engagement between cam surfaces 41 and plunger surfaces 48 holds latch A in the latched position illustrated in FIGS. 5 and 6. When the latch is pivoted toward unlatched position (in the direction of the arrow in FIG. 5) engagement between cam surfaces 41 and plunger surfaces 48 causes the plungers to be driven into housing 20 against the bias of coil springs 44 (assuming the combination lock which will be described hereinafter is "on combination"). This allows cam surfaces 41 to slide with respect to plunger surfaces 48 and permits the latch to be raised. In order to open the latch, the plungers must be driven sufficiently into the housing to allow rounded cam surfaces 43 to pass the rounded tips 46 of the plungers.

When the latch is lowered from unlatched position to latched position, rounded cam surfaces 43 engage plunger surfaces 47 causing the plungers to be driven into the housing and allowing the latch to be lowered. In order to move latch A to latched position, sufficient downward force must be applied to overcome the bias of the coil springs and to drive the plungers sufficiently into the housing to allow the rounded cam surfaces 43 to pass plunger tips 46. Once cam surfaces 43 pass tips 46, coil springs 44 drive the plungers outwardly from the housing, causing surfaces 41 and 48 to engage and causing the latch to be snapped to latched position.

Since the latching device of the invention will typically be employed on soft-sided luggage and similar articles having flexible walls, it is desirable to reduce the downward force necessary to move the latch to latched position. For this purpose, each plunger is formed with a notch 54 adjacent to the lower end of plunger surface 48, as shown in FIG. 6. Disposed within the housing is a bolt spring M (FIG. 8) which is part of the combination locking mechanism of the latching device and which will be described in more detail in connection therewith. The bolt spring preferably has a pair of resilient arms 56 which extend parallel to the plungers within the housing, as shown in FIG. 3. Each arm 56 has a tab 57 at its end which is somewhat wider than arm 56, and a depending portion 58 which extends through an opening 60 (FIG. 12) in the front face 26 of the housing. As shown in FIGS. 3 and 6, tabs 57 are positioned beneath the plungers adjacent to notches 54. In a relaxed condition, arms 56 are biased somewhat upwardly from the plane of the bolt spring, as illustrated in FIG. 8. However, when latch A is in latched position, cam surfaces 42 engage portions 58, as shown in solid lines in FIG. 6, causing arms 56 to be bent downwardly and tabs 57 to be positioned below notches 54.

When the latch is moved from latched position to unlatched position and the plungers are driven into the housing, as previously described, the resilient arms 56 of the bolt spring move to the phantom line position illustrated in FIG. 6 for one such arm. This disposes tabs 57 in positions to engage notches 54 of the plungers. As the rounded cam surfaces 43 pass the tips 46 of the plungers, coil springs 44 drive the plungers outwardly, as previously described, causing notches 54 to engage tabs 57, and holding the plungers in the phantom line position illustrated in FIG. 6. Accordingly, the plungers are held partially driven into the housing when the latch is in unlatched position.

When the latch is subsequently moved to latched position, the plungers, already partially driven into the housing, need only to be driven further inwardly a small amount to allow cam surfaces 43 to pass plunger tips 46. This significantly reduces the downward force required to close the latch. When cam surfaces 42 engage portions 58 of arms 56, they push the arms downwardly against the bias of the spring material, moving tabs 57 out of engaging relationship with notches 54 and allowing the plungers to be driven outwardly to their fully extended positions. As the plungers are driven outwardly, engagement between surfaces 41 and 48 causes latch A to snap closed.

Figure 4:
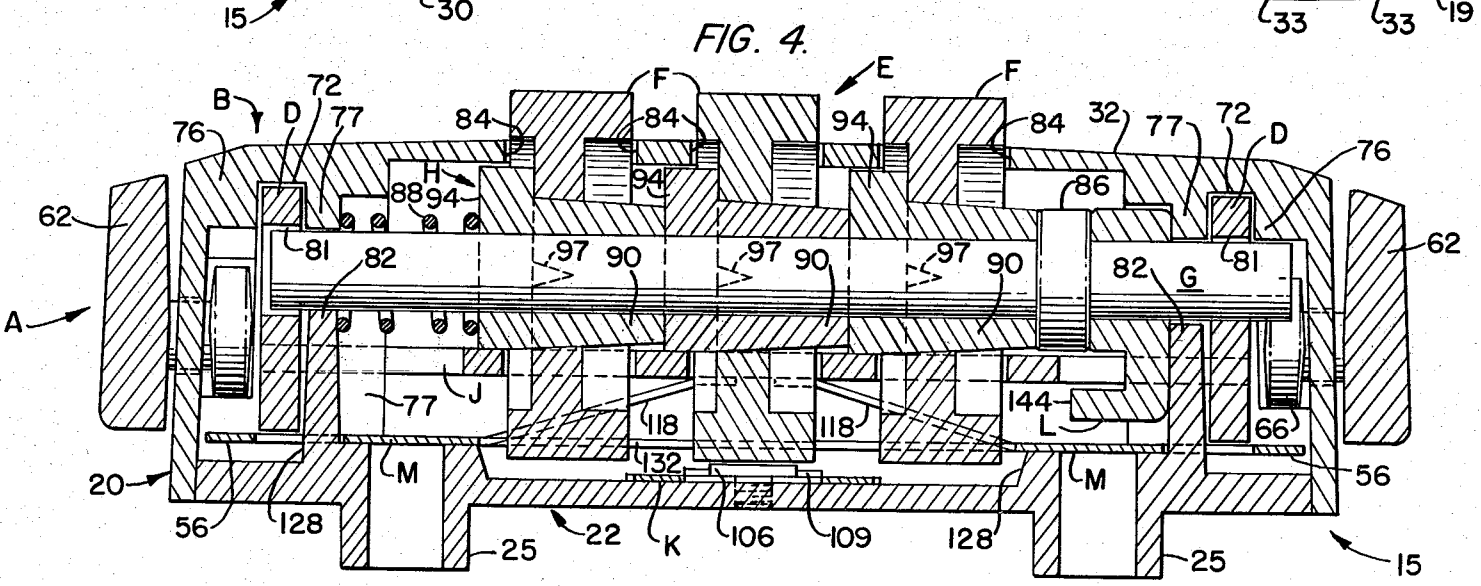
FIG. 4 is a longitudinal sectional view taken approximately along line 4—4 of FIG. 3.

As illustrated in FIGS. 3 and 4, plungers D are preferably confined for sliding movement on frame 22 within slots 72 formed within the housing by a plurality of projections 74, 75, 76, and 77 which are cast downwardly and inwardly from the interior surfaces of the housing. Each plunger may be formed with a cutout 78, a portion of which is somewhat H-shaped as illustrated in FIG. 6, in which coil spring 44 is positioned. A second slotted cutout 81 adjacent to cutout 78 is provided for shaft G of the combination lock. As shown in FIG. 3, the coil springs are confined within cavities 73 formed by projections 74, 75, the interior surfaces of front face 26 and sides 63 of the housing, and projections 79 cast downwardly from the underside of face plate 32 and inwardly from front face 26. Each coil spring is compressed between projections 74 and 75 and the front portion 80 of the H-shaped cutout (FIGS. 3, 5, and 6), thus urging its corresponding plunger outwardly of the housing. When the plungers are driven into the housing by the cams, as previously described, the coil springs are further compressed between front portions 80 and projections 74 and 75, allowing the plungers to slide on the frame.

Figure 12:
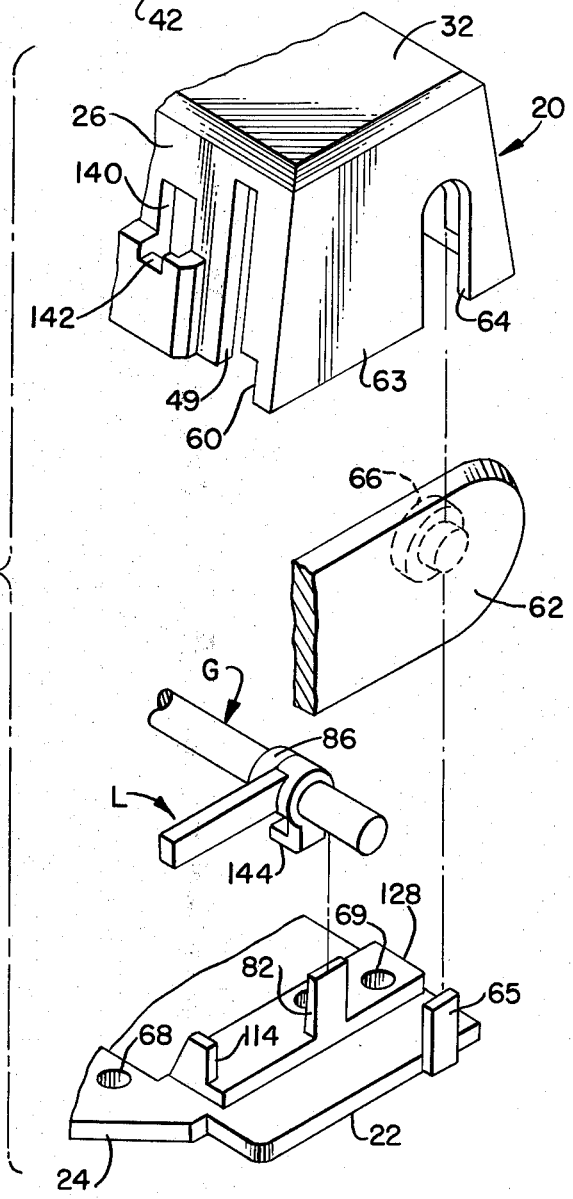
FIG. 12 is an exploded fragmentary perspective view of a portion of the latching device.

As illustrated in FIGS. 2–4 and 11, latch A preferably is generally U-shaped and sized so that its legs 62 extend along opposite sides 63 of housing 20. The housing may have a bearing recess 64 (FIG. 12) formed in each side 63 for receiving an inwardly cast trunnion 66 adjacent to the end of each leg 62 of the latch. Latch A is pivotally mounted on housing 20 by positioning trunnions 66 within bearing recesses 64 and attaching the housing to frame 22. As shown in FIG. 12, frame 22 may have projections 65 (one such projection being shown) which extend into the bearing recesses and closely confine the trunnions when the frame and the housing are assembled. Frame 22 may be attached to housing 20 in any conventional manner, as with countersunk screws 67 (FIGS. 5 and 6) which extend through openings 68, 69 in the frame (FIG. 12) and are threaded into aligned holes in the housing.

Latch A may be formed with a lip 70 along its front edge (FIGS. 2, 5 and 6) to provide a convenient finger-engaging surface to facilitate opening of the latch. The top surface 30 of the latch may be textured, as illustrated in FIGS. 1 and 3, to impart a pleasing appearance to the latching device and to facilitate the attachment of a logo.

The combination locking mechanism E of latching device 15 comprises a plurality of dials F supported for rotation on a shaft G by means of respective, cooperable sleeves H. Shaft G is positioned within housing 20 in recesses formed between projections 75 and 77 and a pair of bearing projections 82 cast upwardly from frame 22 (FIGS. 4 and 12). Each dial F partially extends through a slot 84 in face plate 32 of the housing. The sleeves H are held in successive end-to-end abutting relationship against a collar 86 fixed to shaft G, by means of a coil spring 88 positioned on one end of the shaft between the sleeves and projections 75, 77 and 82 (FIGS. 3 and 4).

Each sleeve H has a circular flange 94 having a chordal flat portion 96, as best illustrated in FIG. 7, and one or more detents 97 which are received in recesses 98 in an associated dial for keying the sleeve to the dial.

As shown in FIGS. 3, 5 and 7, spaced equally around the periphery of each dial are a plurality of indicia, or numbers 99, each being separated from the next by an indexing notch 100. The indexing notches of each dial are cooperable with an arm 104 of a dial spring K (FIG. 9) to hold the dial in a series of rotational positions to centrally display each successive indicium in its slot 84 of the face plate.

Dial spring K (FIG. 9), preferably formed of spring tempered phosphorus bronze, has one arm 104 for each combination dial F (three dials being employed in the preferred form illustrated). Arms 104 may be struck upwardly from a substantially T-shaped flat plate 105, as shown. The dial spring is mounted on frame 22 by a screw 106 threaded through an opening 107 in the spring into the frame (FIGS. 4 and 5). A notch 108 in the dial spring adjacent to opening 107 keys the dial spring to an abutment 109 on the frame to hold the dial spring in the correct position.

Figure 10:
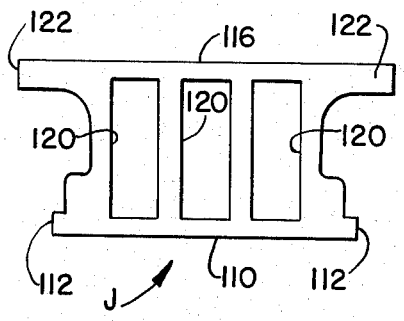
FIG. 10 is a top plan view of a bolt of the combination lock.

A planar bolt member J, shaped as illustrated in FIG. 10, is pivoted within the housing below the shaft about an axis adjacent to one side 110 of the bolt. Tabs 112 extending from the bolt adjacent to side 110 may be confined within cutouts 113 formed in projections 79 (FIG. 5) and may be supported within the cutouts by a pair of spaced projections 114 (one such projection being illustrated in FIGS. 5 and 12) cast upwardly from frame 22. Side 116 of the bolt opposite to side 110 is supported by arms 118 of the bolt spring M (FIG. 8), which urge the bolt to a horizontal position as illustrated in FIG. 5. The dials extend through a plurality of slots 120 in the bolt, as best shown in FIG. 4.

When dials F are turned "on combination", flats 96 of sleeves H are in alignment with the bolt (FIG. 5) allowing the bolt to assume a horizontal (unlocked) position. In the unlocked position, a pair of projecting tabs 122 adjacent to side 116 of the bolt are in alignment with slots or cutouts 124 in the plungers (FIG. 6), allowing the plungers to be driven into the housing. When any dial is turned "off combination" its corresponding sleeve is rotated so that the circular portion 94 of the flange contacts the bolt. This causes the bolt to pivot about tabs 112 and forces side 116 of the bolt downwardly against the bias of bolt spring arms 118 to the position indicated by the phantom lines in FIGS. 5 and 6. In this position, projecting tabs 122 of the bolt are adjacent to the rear edges 126 of the plungers (FIG. 6) preventing the plungers from being driven into the housing. Accordingly, when the combination lock is "off combination" the plungers are locked in their extended position and engagement between the cam members and the plungers prevents latch A from being lifted to unlatched position.

Bolt spring M, preferably formed from spring steel with a shape as illustrated in FIG. 8, may be mounted on a pair of spaced ledge portions 128 (FIGS. 4 and 12) on frame 22. A pair of spaced holes 130 in the bolt spring may be aligned with holes 69 in the frame, through which screws 67 are threaded, to secure the bolt spring in the appropriate position when the frame is assembled with housing 20. As previously described, spaced arms 56 cooperate with cams 36 and plungers D to facilitate movement of the latch to latched position. A central cutout 132, which may be rectangular as shown, provides clearance for the dials F (FIG. 5), and a pair of cutouts 134 adjacent to arms 56 provides clearance for the base 136 of each plunger to slideably contact the frame.

As is well known, means may be incorporated in the combination lock to allow the combination to be changed. As shown in FIGS. 3, 4 and 12, a shift lever L is attached to shaft G adjacent to collar 86 and extends through an opening 140 in the front face 26 of the housing. When the lock is "on combination", the shaft may be shifted to the left in FIGS. 3 and 4 against the bias of spring 88 by the shift lever L. This disengages the sleeves from their corresponding dials. The combination dials may then be rotated to any desired combination. As lever L is moved to the left, it may be rotated slightly downwardly to enter a notch 142 (FIG. 12) formed in front face 26 adjacent to opening 140 to hold the shaft in the shifted position. An angled projection 144 (FIG. 4) of the shift lever L moves beneath the bolt as the shift lever moves to the left to hold the bolt in the horizontal, unlocked position. This prevents rotation of the sleeves when they disengage from the dials. When the lever L is moved out of notch 142, spring 88 forces shaft G to the right so that the sleeves reengage the dials, thereby fixing the new combination into the lock.

As shown in FIGS. 2 and 3, lever L is accessible on the front face 26 of the housing when latch A is lifted from latched position. Accordingly, it is conveniently located for changing the combination. When latch A is in latched position, latch A covers shift lever L prohibiting access to it.

From the foregoing, it can be seen that the latching device of the invention has a number of significant advantages over prior devices. An especially significant feature is the fact that the latch A itself serves to actuate the latching mechanism, without the need for operating a separate manual actuator, allowing the latching device to be operated with one hand. Another significant feature is the provision of means for holding the plungers partially driven into the housing of the latching device when the latch is open, thereby reducing the force required to close the latch. Moreover, the latching device may be made small and compact, which are desirable features when used on luggage cases. When used as a latching device for a double slider zipper, the sliders are covered by the latch when it is in the latched position, protecting the sliders from damage.

While the foregoing has been with reference to a particular illustrated embodiment, it will be appreciated by those skilled in the art that variations are possible without departing from the principles and spirit of the invention, the scope of which is defined in the appended claims.

What is claimed is:

1. A latching device for latching a slider of a zipper comprising a base, a housing mounted on the base, the base having a portion extending beyond the housing, a stud mounted on the extended portion of the base, the stud formed to be received through an aperture in a zipper slider pull tab, a latch pivotally mounted on the base, the latch having a latched position at which it covers the stud and the zipper slider and an unlatched position, plunger means slideably related to the housing for releasably engaging cooperable means on the latch for holding the latch in latched position, the plunger means being driven into the housing by the cooperable means when the latch is moved between latched and unlatched positions, spring means for biasing the plunger means toward engagement with the cooperable means, and means releasably engageable with the plunger means for holding the plunger means at least partially driven into the housing when the latch is in unlatched position, the holding means being biased to engage the plunger means and being held against such engagement by the latch when the latch is in the latched position and being permitted to move into said engagement when the latch is in the unlatched position.

2. The device of claim 1, wherein the holding means engageable with the plunger means comprises resilient means biased to engage a notch on the plunger means when the plunger means is driven into the housing and the latch is in the unlatched position.

3. The device of claim 2, wherein the cooperable means on the latch comprises cam means and the plunger means has a wedge-shaped end portion for engaging the cam means.

4. The device of claim 3, wherein the cam means engages the resilient means to move the resilient means to a non-engaging position with respect to the notch on the plunger means when the latch is moved to the latched position.

5. The device of claim 1 comprising locking means for locking the plunger means in latched position.

6. The device of claim 1, wherein the device is attached to a luggage case and the zipper is a double-slider zipper employed as a closure on the luggage case, the zipper having a pair of zipper sliders adapted to be brought together to close the luggage case, each slider having a pull tab with an aperture therein, and the device is related to the zipper such that the stud is positioned to receive the apertures when the zipper sliders are brought together.

7. A latching device for latching a slider of a zipper comprising a base, a housing mounted on the base, the base having a portion extending beyond the housing, a stud mounted on the extended portion of the base, the stud formed to be received through an aperture in a zipper slider pull tab, a latch pivotally mounted on the base, the latch having a latched position at which it covers the stud and the zipper slider and an unlatched position, a pair of spaced plungers slideably disposed within the housing and having wedge-shaped end portions projecting through slots in the housing for releasably engaging cooperable cams on the underside of the latch for holding the latch in latched position, the plungers being driven into the housing by the cams when the latch is moved between latched and unlatched positions, spring means for biasing the plungers toward engagement with the cams, and resilient means biased to releasably engage a notch on each plunger to hold the plungers partially driven into the housing when the latch is in unlatched position, thereby reducing the force required to move the latch to latched position, the cams engaging the resilient means to move the resilient means to a non-engaging position with respect to the notches when the latch is moved to the latched position.

8. The device of claim 7, wherein the latch is U-shaped having a pair of legs extending from a central portion, the legs having trunnions received within bearing recesses on opposite sides of the housing, the central portion of the latch covering the extended portion of the base with the stud adjacent to the underside of the central portion of the latch, and the latch being substantially flush with a top surface of the housing when the latch is in latched position.

9. A latching device comprising a housing, a latch pivotally mounted on the housing, the latch having a latched position at which the latch is adjacent to the housing and having an unlatched position at which the latch is pivoted away from the housing, plunger means slideably related to the housing and being releasably engageable with the latch to hold the latch in latched position, the plunger means being driven into the housing by the latch when the latch moves between latched and unlatched positions, resilient means for biasing the plunger means toward engagement with the latch, and means for holding the plunger means at least partially driven into the housing when the latch is in unlatched position, thereby reducing the force required to move the latch to latched position, the holding means being biased to engage the plunger means and being held against such engagement by the latch when the latch is in the latched position and being permitted to move into said engagement when the latch is in the unlatched position.

10. The device of claim 9, wherein the means for holding the plunger means at least partially driven into the housing comprises a resilient member biased to engage the plunger means when the plunger means is driven into the housing and the latch is in unlatched position.

11. The device of claim 9, wherein the housing is mounted on a base having an extended portion, the base having a stud positioned on the extended portion, and wherein the latch covers the extended portion of the base and the stud and is substantially flush with the top of the housing when the latch is in the latched position.

12. The device of claim 11, wherein the latch includes an opening for receiving a member having an aperture, the opening being positioned such that the stud is adapted to extend through the aperture.

13. The device of claim 12, wherein the device is a latching device for a double-slider zipper, the device being positioned with respect to the zipper such that when the sliders are brought together to close the zipper, the stud is positioned to extend through an aperture formed in the pull tab of each slider, and wherein the latch covers the sliders when in latched position.

14. A latching device for latching a slider of a zipper comprising a base, a housing mounted on the base, the base having a portion extending beyond the housing, a stud mounted on the extended portion of the base, the stud formed to be received through an aperture in a zipper slider pull tab, a latch pivotally mounted on the base, the latch having a latched position at which it covers the stud and the zipper slider and an unlatched position, plunger means slideably related to the housing for releasably engaging cooperable means on the latch for holding the latch in latched position, the plunger means being driven into the housing by the cooperable means when the latch is moved between latched and unlatched positions, spring means for biasing the plunger means toward engagement with the cooperable means, and locking means comprising a pivoted bolt movable to block the movement of the plunger means for locking the latch in latched position.

15. The device of claim 14, wherein the locking means comprises a combination lock positioned within the housing for controlling the movement of the pivoted bolt.

16. The device of claim 15, wherein the plunger means comprises a planar member slideably disposed on the base within the housing, the member having an end portion projecting through a slot in the housing in the direction of the extended portion of the base for engaging the cooperable means and having a notch in an opposite end for receiving the pivoted bolt when the bolt is in unlocked position and the member is slid into the housing.

17. A latching device comprising a housing, a latch pivotally mounted on the housing, the latch having a latched position at which the latch is adjacent to the housing and having an unlatched position at which the latch is pivoted away from the housing, plunger means slideably related to the housing and being releasably engageable with the latch to hold the latch in latched position, the plunger means being driven into the housing by the latch when the latch moves between latched and unlatched positions, resilient means for biasing the plunger means toward engagement with the latch, a resilient member biased to engage the plunger means when the plunger means is driven into the housing for holding the plunger means partially driven into the housing when the latch is in unlatched position, thereby reducing the force required to move the latch to latched position, and a pivoted bolt combination lock disposed within the housing for blocking movement of the plunger means into the housing when the lock is off combination.

18. The device of claim 17, wherein the combination lock comprises a bolt spring for biasing the pivoted bolt toward unlocked position, and wherein the resilient member comprises an arm of the bolt spring having a tab positioned to engage a notch in the plunger means.

* * * * *